US007761935B1

(12) United States Patent
Whitaker

(10) Patent No.: US 7,761,935 B1
(45) Date of Patent: Jul. 27, 2010

(54) SHOWER CURTAIN WITH FLAP FOR USE WITH TUB TRANSFER BENCH

(76) Inventor: Jennifer L. Whitaker, 14318 Denby Ter., Midlothian, VA (US) 23114

( * ) Notice: Subject to any disclaimer, the term of this patent is extended or adjusted under 35 U.S.C. 154(b) by 291 days.

(21) Appl. No.: 11/503,876

(22) Filed: Aug. 11, 2006

(51) Int. Cl.
*A47K 3/08* (2006.01)

(52) U.S. Cl. ..... 4/558; 4/608

(58) Field of Classification Search ..... 4/557, 4/558, 607–609; 160/179, 330
See application file for complete search history.

(56) References Cited

U.S. PATENT DOCUMENTS 1,545,093 A * 7/1925 Gallob ..... 160/349.2
2,840,155 A * 6/1958 Stern ..... 160/124
3,145,719 A * 8/1964 Johnson ..... 52/2.21
4,316,345 A * 2/1982 Rivette et al. ..... 446/387
5,127,460 A * 7/1992 Abadi et al. ..... 160/332
5,450,890 A * 9/1995 Pinkalla et al. ..... 160/121.1
6,041,454 A * 3/2000 Summerford ..... 4/558
6,336,232 B1 * 1/2002 Toder ..... 4/608
2001/0020618 A1 * 9/2001 Kellogg et al. ..... 220/9.2
2006/0060235 A1 * 3/2006 Ball ..... 135/136

* cited by examiner

*Primary Examiner*—Huyen Le

(57) ABSTRACT

A shower curtain with an integral flap for accommodating a tub transfer bench. The flap, located along the bottom edge of the shower curtain, can be pulled into the slot of a tub transfer bench to prevent water from splashing outwards of the bathtub. Two side slits bound the flap and reinforcing material is provided at the boundary of the side slits to reduce the possibility of tear propagation. A handle may be provided at the lower end of the flap to facilitate easy grasping of the flap. The shower curtain may further include straps having hook-and-loop pads at the top edge to facilitate easy hanging and removal of the shower curtain from a conventional shower curtain rod.

2 Claims, 6 Drawing Sheets

SHOWER CURTAIN WITH FLAP FOR USE WITH TUB TRANSFER BENCH

FIELD OF THE INVENTION

This invention relates to devices for assisting elderly or physically handicapped people with showers and baths and specifically to a shower curtain for use with a bathtub and a tub transfer bench to eliminate the occurrence of water splashing outside of the bathtub.

BACKGROUND OF THE INVENTION

Those who are elderly, physically handicapped, wheelchair bound, or otherwise impaired in their mobility frequently need assistance or special equipment when taking baths. Tub transfer benches are commonly used to enable the physically impaired to take a bath or a shower. The tub transfer benches typically include a two-part seat, a backrest, and legs that enable the bench to straddle the outer wall of a bathtub or tub-shower.

As shown in FIGS. 1 and 2, the tub transfer bench 20 includes inner legs 22 and outer legs 24, with the inner legs 22 shorter than the outer legs 24 to enable the bench 20 to be level when the bench straddles the outer wall 26 of the bathtub 28. The tub transfer bench typically includes the two-part seat 29, including an inner portion 30 and an outer portion 32, to provide a gap 34 to accommodate the conventional shower curtain 36 of the tub-shower. The term "tub transfer bench" is derived from the two-part seat 29, which enables a person to transfer their weight from the outer seat 32 outside the tub-shower, to the inner seat 30 inside the tub-shower, without standing or raising their weight off of the two-part seat 29. The gap 34 is provided for accepting the lower portion of the shower curtain 36 in an attempt to prevent water from splashing out of the bathtub or tub-shower.

Although the two-part seat 29 of the tub transfer bench 20 includes a gap 34, the bench 20 also includes the framework 38 that connects the inner 30 and outer 32 parts of the seat. The gap 34 between the inner 30 and outer parts 32 of the seat is also constricted by the framework 38 that connects the seat portions. The gap 34 is therefore typically in the form of a slot 40 (see FIG. 2) bounded by the two portions of the seat 30 and 32 and by the framework 38 of the tub transfer bench 20. The framework 38 bounding the slot 40 typically includes two substantially horizontal posts 42 as shown in FIG. 2.

Unfortunately, when a conventional shower curtain 36 is placed upon the gap 34 of the tub transfer bench 20, as shown in FIG. 3, the shower curtain 36 bunches up upon the posts 42. This typically creates a hole 43 between the shower curtain 36 and the outer wall 26 of the bathtub 28. Attempts to reduce the size of the hole 43 by pulling the bunched up portion of the shower curtain 36 through the slot 40 are difficult as the slot 40 is small and the bunched up portion does not move easily through the slot 40. Additionally, it is difficult for a physically handicapped or elderly person to reach under the seat of the tub transfer bench 20 to pull the shower curtain 36 through the slot 40. Therefore, conventional shower curtains do not adequately prevent water from splashing outside of the shower or bathtub.

SUMMARY OF THE INVENTION

The invention is a shower curtain with an integral flap for accommodating a tub transfer bench. The flap, located along the bottom edge of the shower curtain, can be pulled into the slot of a tub transfer bench to prevent water from splashing outwards of the bathtub. Two side slits bound the flap and reinforcing material is provided at the boundary of the side slits to reduce the possibility of tear propagation. A handle may be provided at the lower end of the flap to facilitate easy grasping of the flap. The shower curtain may further include straps having hook-and-loop pads at the top edge to facilitate easy hanging and removal of the shower curtain from a conventional shower curtain rod.

OBJECTS AND ADVANTAGES

Several advantages are achieved with the shower curtain with flap of the present invention, including:

(1) The shower curtain of the present invention includes slits and a flap to allow it to fit snugly over the posts of a conventional tub transfer bench when situated in a bathtub and thereby prevent water from escaping the bathtub in the vicinity of the posts.

(2) Reinforcement is provided around the periphery of the slits of the shower curtain of the present invention to prevent tearing in the vicinity of the slits.

(3) A handle at the lower end of the flap facilitates grasping of the flap thereby making it easy to insert and remove the flap from the slot area of a conventional tub transfer bench.

(4) The shower curtain of the present invention includes straps having hook-and-loop pads at the top edge to facilitate easy hanging and removal of the shower curtain from a conventional shower curtain rod.

These and other objects and advantages of the present invention will be better understood by reading the following description along with reference to the drawings.

INDEX TO REFERENCE NUMERALS IN DRAWINGS

Figure 1:
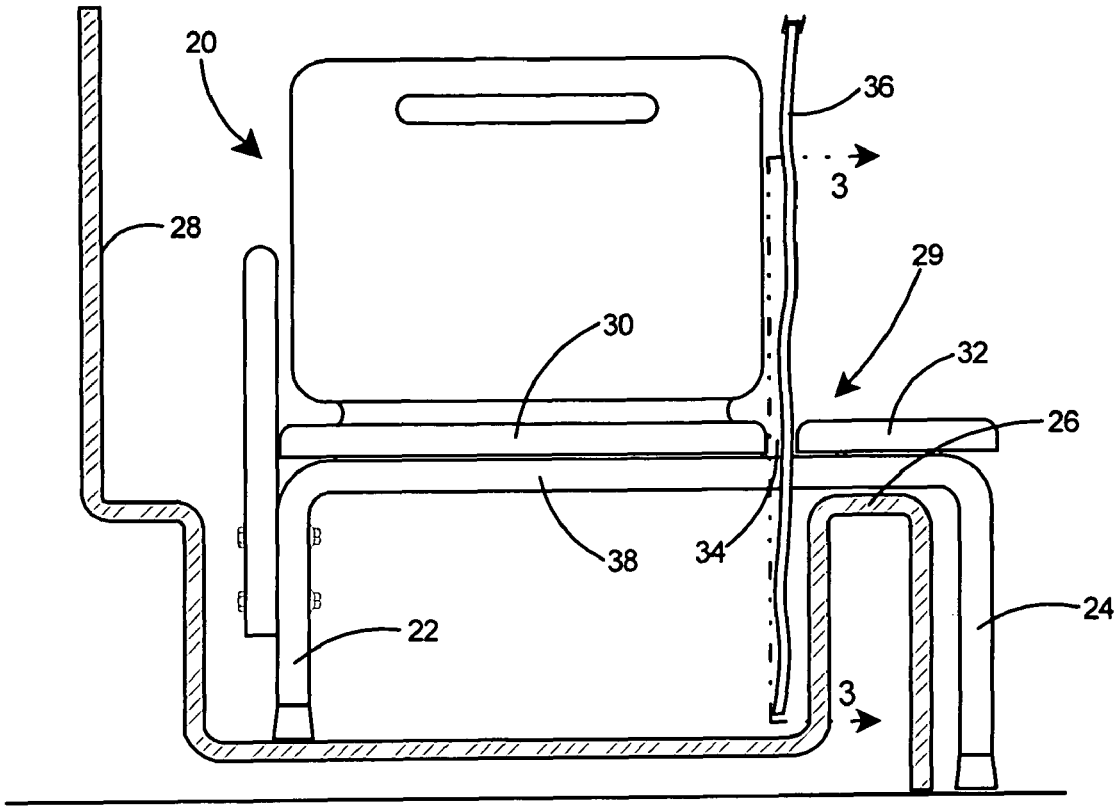
FIG. 1 is a front elevation view of a tub transfer bench placed in a bathtub and a conventional shower curtain.

20 conventional tub transfer bench
22 inner leg of tub transfer bench
24 outer leg of tub transfer bench
26 outer wall of bathtub
28 bathtub
29 two-part seat
30 inner portion of seat
32 outer portion of seat
34 gap
36 conventional shower curtain
38 framework of tub transfer bench
40 slot
42 horizontal post
43 hole
50 shower curtain, first embodiment
52 slit
54 flap
56 top aperture
58 metal grommet
60 shower curtain, second embodiment
62 sheet
64 top edge of sheet
66 bottom edge of sheet
68 side edge of sheet
70 slit or opening
72 slit edge
74 flap
76 side edge of flap
78 bottom edge of flap
80 reinforced area
82 folded over portion
84 strip of reinforcing material
88 strap
90 shower curtain, third embodiment
91 reinforced area along bottom edge of flap
94 handle
96 first end of strap
98 second end of strap
100 hook arrangement
102 loop arrangement
104 shower curtain rod
106 shower curtain, preferred embodiment
108 hook and loop tab
W1 width of flap
W2 width of tub transfer bench between the posts

DETAILED DESCRIPTION OF THE INVENTION

Figure 2:
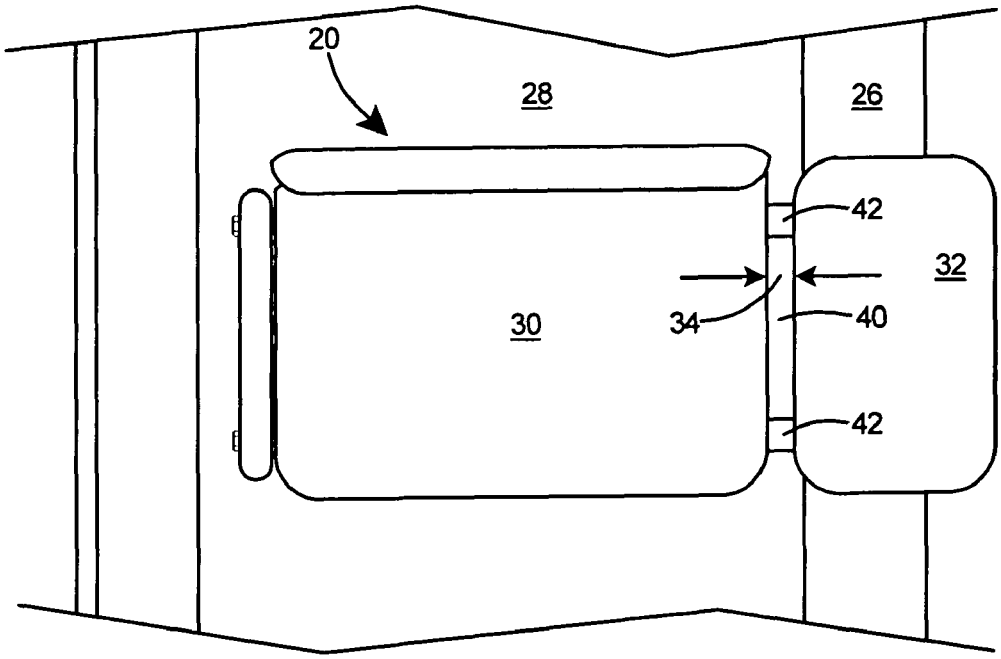
FIG. 2 is a top view of the tub transfer bench and bathtub of FIG. 1.
Figure 3:
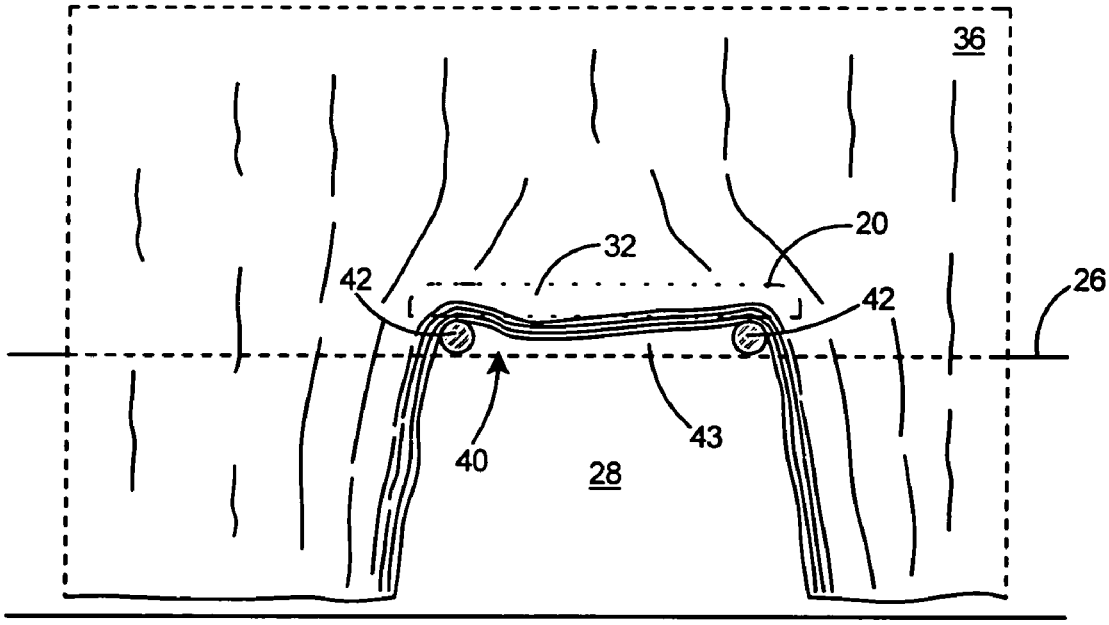
(PRIOR ART) Fig. 3
FIG. 3 is a view of a conventional shower curtain and tub transfer bench taken along line 3-3 of FIG. 1.
Figure 4:
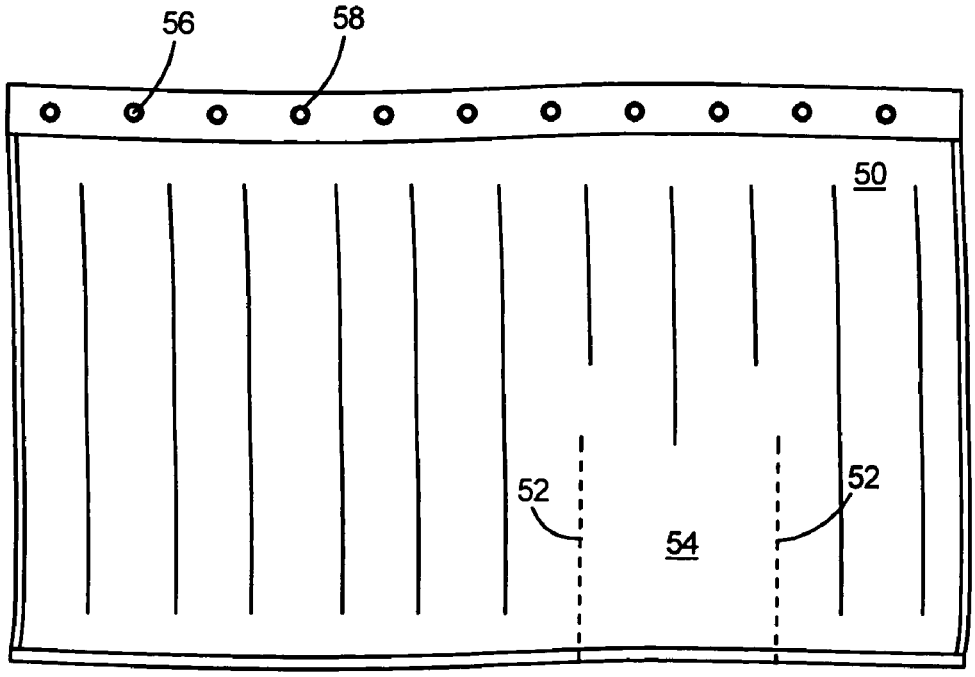
FIG. 4 is an elevation view of the first embodiment of a shower curtain with flap according to the present invention.

With reference to FIG. 4 there is shown a first embodiment of a shower curtain 50 according to the present invention to be used in conjunction with a tub transfer bench to prevent water from splashing out of the bathtub. The shower curtain 50 includes two slits 52 to accommodate the posts of a conventional tub transfer bench (see FIG. 2). The two slits 52 define a flap 54 in the shower curtain 50 and, when the shower curtain 50 is closed upon a tub-shower having a tub transfer bench, the flap 54 can be pulled through the slot 40 (see FIG. 2) to completely seal around the tub transfer bench and prevent water from splashing outside the tub. The shower curtain 50 includes top apertures 56 and grommets 58 to accommodate hooks for hanging from a shower curtain rod (not shown).

Figure 5:
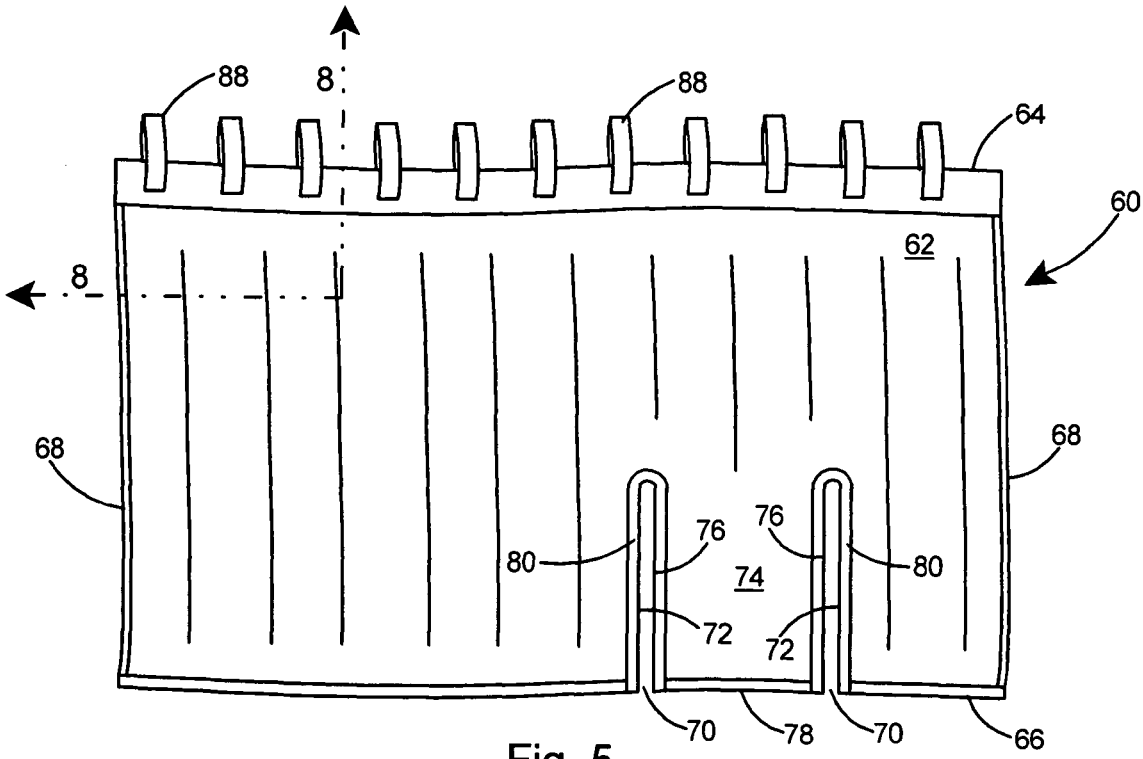
FIG. 5 is an elevation view of the first embodiment of a shower curtain with flap according to the present invention.

With reference to FIG. 5 there is shown a second embodiment of a shower curtain 60 of the present invention. The shower curtain 60 includes a generally rectangular sheet 62 having a top edge 64, a bottom edge 66, and two side edges 68. Two slits 70 or openings extend upwards from the bottom edge 66 of the sheet 62 and include slit edges 72 surrounding the slits 70. The slits 70 define a flap 74 in the sheet 62. The flap 74 is generally located between the two side edges 68 of the sheet 62 and includes side edges 76 and a bottom edge 78.

Figure 12:
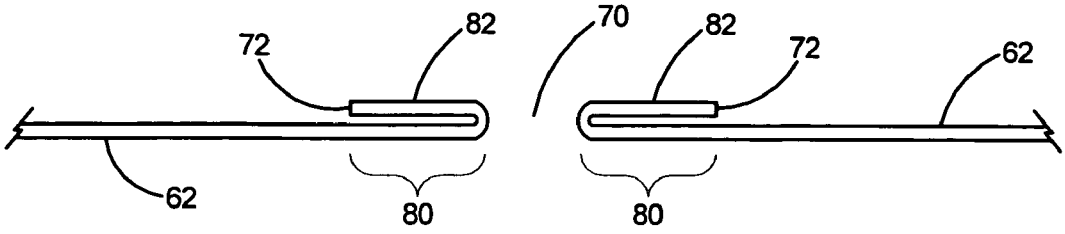
FIG. 12 is an end view of the area surrounding a slit or opening at the edges of a flap, which includes a folded over portion of the sheet that will form a reinforced area surrounding the flap.
Figure 13:
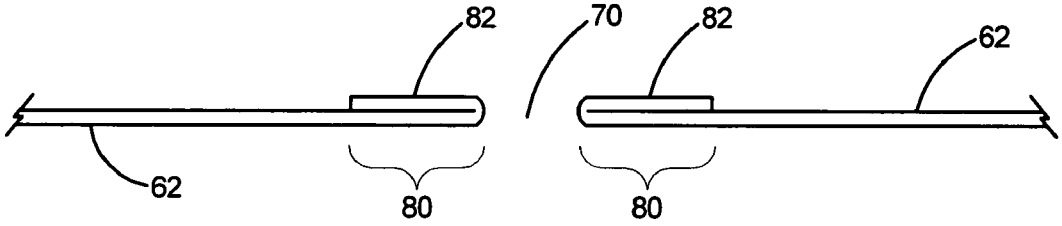
FIG. 13 is an end view similar to that of FIG. 12 but with the folded over portion is bonded together to form the reinforced area.

Although shower curtains, being water impervious, perform well in repelling water, they do not exhibit adequate tear resistance. The shower curtain 60 depicted in FIG. 5 therefore includes a reinforced area 80 along the bottom edge 78 and side edges 76 of the flap 74, with the reinforced area 80 surrounding each of the slits 70. As shown in FIG. 12, the reinforced area 80 may include a folded over portion 82 of the sheet 62 at the slit edges 72. The shower curtain 60 are can be constructed of polyethylene, polyvinyl chloride, or any other appropriate water impervious plastics. After being folded over, as shown in FIG. 13, the folded over portion 82 and the sheet 62 are preferably bonded together by heat, adhesive, ultrasonic energy, stitching, staples or a combination thereof.

Figure 14:
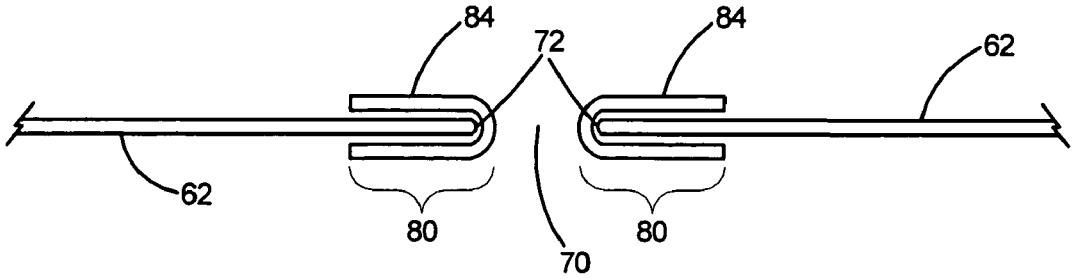
FIG. 14 is an end view similar to that of FIG. 12 but with the reinforced area comprising a strip of reinforcing material that will be secured to the sheet.

With reference to FIG. 14, the reinforced area 80 may include a strip of reinforcing material 84 at the slit edges 72. The reinforcing material 84 can be constructed of plastic, fabric, or fiber and is preferably bonded to the sheet 62 by heat, adhesive, ultrasonic energy, ultraviolet light, or infrared light, or secured to the sheet 62 by stitching, staples or a combination thereof. The reinforced slits 70 can be of various shapes, including an inverted U-shape (see FIG. 5) or an inverted V-shape (see FIG. 6).

With reference to FIG. 5, the second embodiment of the shower curtain 60 of the present invention further includes a plurality of straps 88 along the top edge 64 of the sheet 62. The reinforced slits or openings 70, which can be of various shapes, are an inverted U-shape in the embodiment shown in FIG. 5.

Figure 6:
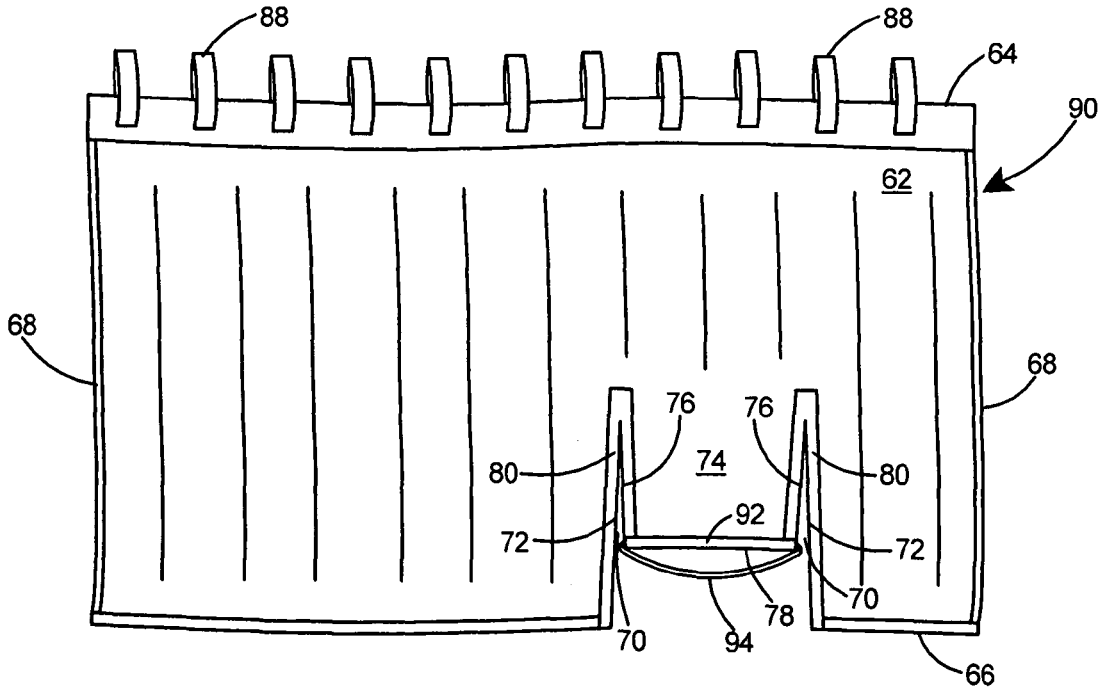
FIG. 6 is an elevation view of a second embodiment of a shower curtain with flap according to the present invention including a handle along the bottom edge of the flap.

Referring to FIG. 6, a third embodiment of the shower curtain 90 of the present invention includes a reinforced area 92 along the bottom edge 78 of the flap 74. The reinforced area 92 can include a folded over portion of the sheet 62 or can be a strip of fabric or plastic folded around the bottom edge and bonded thereto by heat, adhesive, ultrasonic energy, stitching, staples or a combination thereof. The third embodiment of the shower curtain 90 includes a handle 94 extending from the bottom edge 78 of the flap 74. The handle 94 is preferably a cord of which the material of construction of the cord is preferably nylon, cotton, or plastic. As the present invention would typically be utilized by those who are elderly or have physical handicaps, the handle 94 provides a convenient grasping member for pulling the flap 74 through the narrow slot of the tub transfer bench (see FIG. 2). As shown in FIG. 6, the flap 74 may be constructed of a shorter length than the shower curtain sheet 62, as the shorter length remains long enough to prevent water from splashing over the outer wall 26 of the bathtub but provides the advantage of keeping the handle 94 out of any standing water at the bottom of the bathtub. The cord may be treated with bactericides or fungicides to prevent rapid mildewing of the cord, which will experience repeated wettings in a shower or bath environment. The handle 94 is held by the reinforced area 92 or folded over portion on the bottom edge 78 of the flap 74. The reinforced slits or openings 70 are an inverted V-shape in the embodiment shown in FIG. 6. The sheet 62 includes slit edges 72 surrounding the slits 70.

Figure 8:
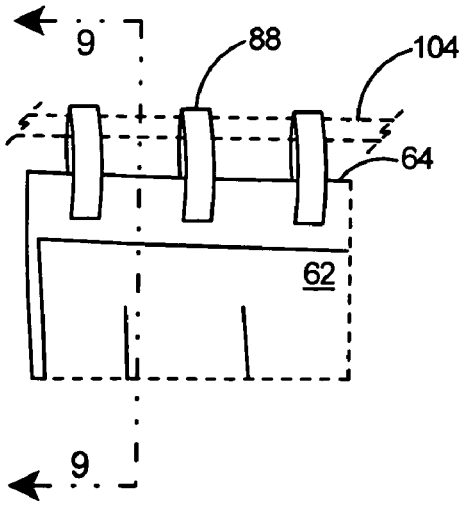
FIG. 8 is a view of the upper left corner of the shower curtain delineated by line 8-8 of FIG. 5 and showing a few of the straps along the top edge of the shower curtain of the present invention.
Figure 9:
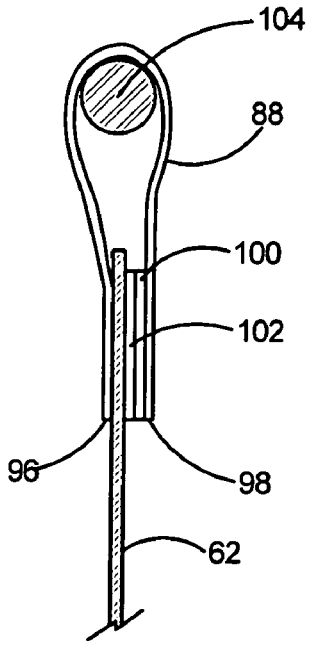
FIG. 9 is a sectional view of the shower curtain of the present invention taken along line 9-9 of FIG. 8 and showing a detailed side view of a strap.
Figure 10:
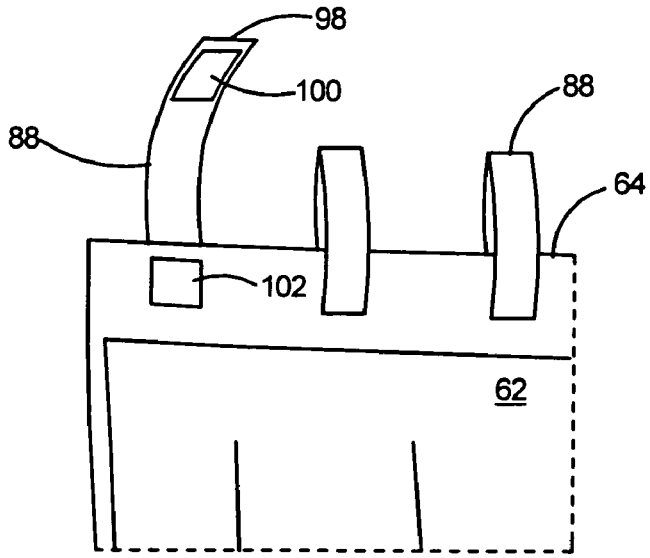
FIG. 10 is a view of the upper left corner of the shower curtain delineated by line 8-8 of FIG. 5 and showing one open and two closed straps along the top edge of the shower curtain.
Figure 11:
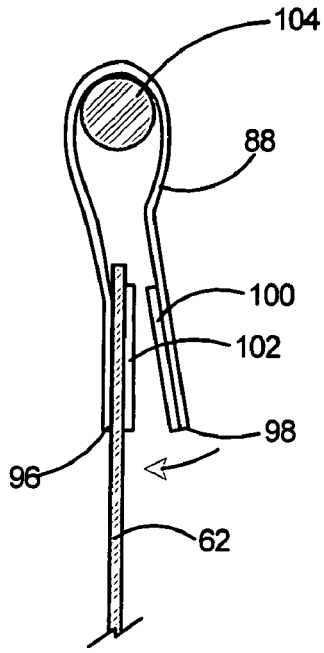
FIG. 11 is a side view of an open strap according to the present invention in position to be closed around a conventional shower curtain rod.

Referring to FIGS. 8-10, the straps 88 include a first end 96 and second 98 end with the first end 96 of the strap 88 bonded to the sheet 62 and the second end 98 includes a hook arrangement 100 thereon. A loop arrangement 102 is included on the sheet 62 in alignment with the hook arrangement 100 on the second end 98. As shown in FIG. 11, the strap 88 may be routed around a shower curtain rod 104 and then secured to the sheet 62 by contacting the hook arrangement 100 of the strap 88 with the loop arrangement 102 of the sheet. Suitable single-sided hook materials and single-sided loop materials for the hook arrangement 100 and the loop arrangement 102 are known as Velcro® brand fasteners and are available from commercial vendors such as Industrial Webbing Corporation in Boynton Beach, Fla. Industrial Webbing's Pressure Sensitive Velcro® or Sew-On Velcro® are preferable for use with the straps 88 and the sheet 62 of the present invention.

Figure 7:
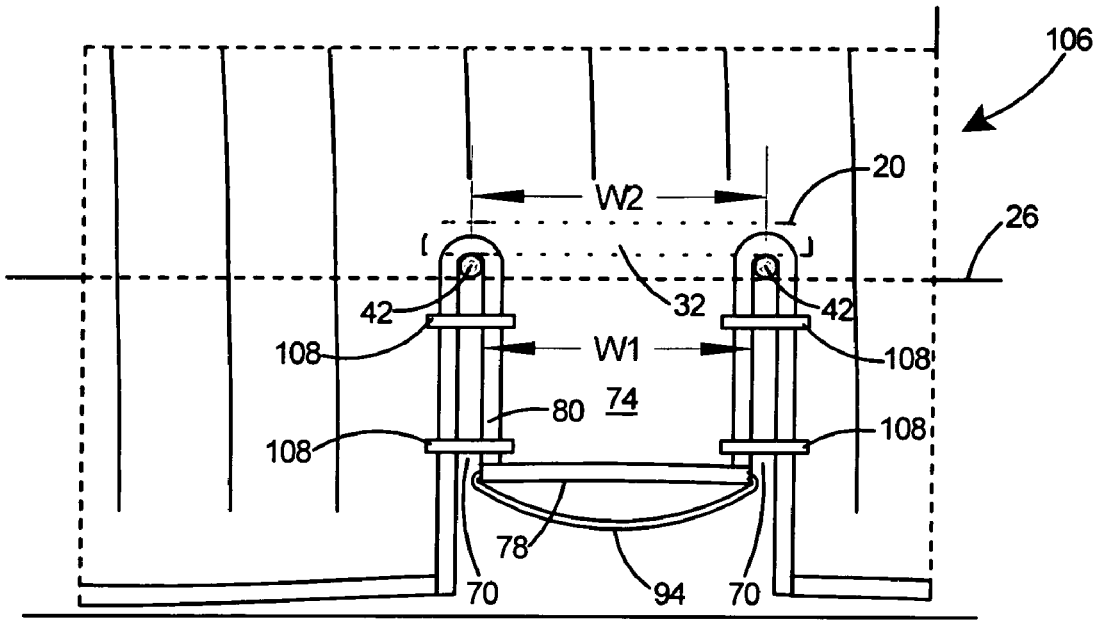
FIG. 7 is a view of the center portion of a shower curtain similar to that shown in FIG. 5 but depicting a preferred embodiment of a shower curtain according to the present invention placed between the bathtub and the outer seat of a conventional tub transfer bench and including hook and loop tabs connecting the flap to the side portions of the shower curtain.

With reference to FIG. 7, there is shown a preferred embodiment of the shower curtain 106 of the present invention having inverted U-shaped openings 70 and a handle 94 at the bottom edge 78 of the flap 74. Preferably the flap 74 of the shower curtain 106 has a width $W_1$ that is 10 to 20% greater than the width $W_2$ of the tub transfer bench, as measured between the two horizontal posts 42, that it is used in conjunction with. With the flap 74 wider than the distance between the posts 42, the shower curtain 106 of the present invention will accommodate a variety of conventional tub transfer benches, as the flap 74 can be bunched to fit benches that have narrow widths between the posts 42. Preferably the width of the shower curtain sheet 62 is also 10 to 30% greater in width than the length of a bathtub that it is used in conjunction with. Having the shower curtain wider than the bathtub enables the flap 74 to be slid sideways with respect to the bathtub to adjust the position of the flap 74 with respect to the tub transfer bench. The tub transfer bench is typically positioned toward an end of the shower or bathtub having the spigot or showerhead, but the extra width of the shower curtain 106 accommodates easy adjustment of the flap with respect to the location of the tub transfer bench. Although the handle 94 is depicted as a loop in FIG. 7, it can also be two separate cords (not shown) extending from the flap 74. One cord would be used for pulling the flap into and through the slot and the other cord retained outwards of the slot. With this type of two-cord handle, the second cord would be used to pull the flap out of the slot at the conclusion of the bath.

With reference to FIGS. 7-11, the shower curtain 106 of the present invention is operated by placing the straps 88 (see FIG. 11) around the shower curtain rod 104 and securing the second end 98 of each strap 88 to the loop arrangement 102 on the shower curtain 106. The flap 74, located nearer one side of the shower curtain than the other (see FIG. 6) and the shower curtain is reversible with respect to the rod 104 thereby allowing the user to position the flap toward the end of the bathtub that contains the spigot or showerhead and the tub transfer bench. The flap 74 of the shower curtain is then grasped by the handle 94 and pulled through the slot 40 of the tub transfer bench. At this point the top of the openings 70 are around the posts 42 of the tub transfer bench 20 and water is prevented from splashing from the bathtub. The reinforced area 80 around the flap 74 prevents tearing and thereby preserves the integrity of the shower curtain 106 through repeated uses.

As shown in FIG. 7, the shower curtain 106 may further include hook and loop tabs 108 connecting the flap 74 to the side portions of the shower curtain to further restrict water spillage at the slits 70 surrounding the posts 42. After the flap 74 is pulled downward into the slot and around the posts 42, the hook and loop tabs 108 would be secured to further limit water splashing outwards at the slits 70. The hook and loop tabs 108 are preferably constructed of Velcro® brand fasteners.

Referring to FIG. 6, the shower curtain of the present invention for use with a tub transfer bench and a bathtub is formed by providing a substantially rectangular sheet 62 having two side edges 68, a top edge 64, and a bottom edge 66. Two slits 70 are provided in the sheet 62, with the slits 70 extending upwards from the bottom edge 66 of the sheet 62 and defining a flap 74 having side edges 76 and a bottom edge 78. A reinforced strip 80 is provided extending along the side edges 76 and the bottom edge 78 of the flap 74. An attachment arrangement 88 is provided along the top edge 64 of the sheet 62 for attaching the sheet to a shower curtain rod 104 (see FIG. 11). The width of the flap 74 between the side edges 76 is equal to or greater than the width of the tub transfer bench 20 as measured between the posts 42 (see FIG. 7). Preferably the shower curtain sheet 62 of the present invention is constructed of polyethylene, polyvinyl chloride, or other appropriate water impervious plastic. As shown in FIG. 7, the bottom edge 78 of the flap 74 is preferably at a higher level than the bottom edge 66 of the sheet 62, although it could be at an equal level with the sheet 62 as shown in the embodiment of FIG. 5. Although a reinforced area 80 is shown herein surrounding the flap 74, the reinforced area would not be necessary if the shower curtain of the present invention were constructed of a water impervious material with high tear strength. For example, the shower curtain could be constructed of rip-stop nylon with a water repellant coating, which would obviate the need for a reinforced area surrounding the flap.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A shower curtain for use with a tub transfer bench and a bathtub comprising:

a generally rectangular sheet having a free top edge, a bottom edge, and two side edges;

a plurality of apertures in said top edge of said sheet, a metal grommet surrounding each of said apertures;

two slits extending upward from said bottom edge of said sheet, said slits inverted V-shaped slits including slit edges;

said slits defining a downward extending flap at said bottom edge of said sheet, said flap generally between said two side edges of said sheet, said flap including a bottom edge, said bottom edge of said flap including a reinforced area, said reinforced area of said flap including a folded over portion of said sheet;

a reinforced area substantially surrounding each of said slits, said reinforced area including a strip of reinforcing material at said slit edges;

a handle extending from said bottom edge of said flap, said handle is held by said folded over portion of said sheet, said handle a cord selected from the group including nylon, cotton, and plastic;

hook and loop tabs connecting said flap to said sheet at said slits;

a plurality of straps along said top edge of said sheet;

a hook arrangement on said straps;

a loop arrangement on said sheet; and said flap capable of being folded or rolled upward such that said bottom edge of said flap is raised above said bottom edge of said sheet.

2. The shower curtain of claim 1 wherein said slit is an inverted U-shape.

* * * * *